United States Patent [19]

Assael

[11] Patent Number: 4,993,558

[45] Date of Patent: Feb. 19, 1991

[54] BOOK AND TRANSCRIPTION FILE

[76] Inventor: Daniel C. Assael, c/o Assael Creative, Inc., 63 Downing St., New York, N.Y. 10014

[21] Appl. No.: 372,637

[22] Filed: Jun. 28, 1989

[51] Int. Cl.[5] ..... A47F 7/00

[52] U.S. Cl. ..... 211/40; 211/41; 211/43; 312/10

[58] Field of Search ..... 211/40, 41, 42, 43, 211/184; 312/8, 9, 10, 12, 15, 16

[56] References Cited

U.S. PATENT DOCUMENTS

| | | | |
|---|---|---|---|
| 527,897 | 10/1894 | Stikeman | 211/43 |
| 1,237,101 | 8/1917 | Ryan | 211/43 |
| 1,621,410 | 3/1927 | House | 211/43 |
| 1,674,582 | 6/1928 | Wheeler | 211/43 |
| 1,688,224 | 10/1928 | Bell | 312/10 |
| 1,780,872 | 11/1930 | Dumben | 211/43 |
| 2,684,765 | 7/1954 | Lowenstein | 211/43 |
| 3,297,164 | 1/1967 | Hutchinson | 211/42 |
| 3,476,455 | 11/1969 | Barecki et al. | 312/8 X |
| 3,866,990 | 2/1975 | McRae | 312/15 |

*Primary Examiner*—Robert W. Gibson, Jr.
*Attorney, Agent, or Firm*—Natter & Natter

[57] ABSTRACT

A book and cassette file system for coordinating books and companion audio transcription cassettes includes a base and a pair of book ends. Each book end includes compartments for storing audio cassettes. A base is provided for supporting the books and the book ends and various mechanisms are illustrated for preventing the book ends from being displaced laterally. A projection extends from either the base or the book end and is received in one of a plurality of receptacles for securing each book end in a desired position along the base. Optionally, a keyway is provided in the base and a key projecting from a book end is engaged in the keyway. In a further embodiment, a spring anchored to one end of a keyway formed in the base is secured at its opposite end to one of the book ends. Another spring is anchored at the other end of the base and secured to the opposite book end.

10 Claims, 5 Drawing Sheets

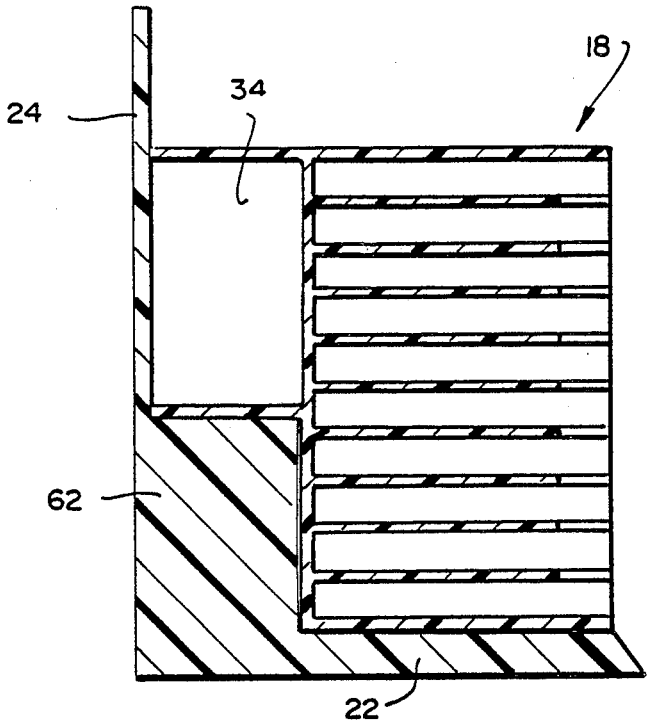
FIG. 7
FIG. 8
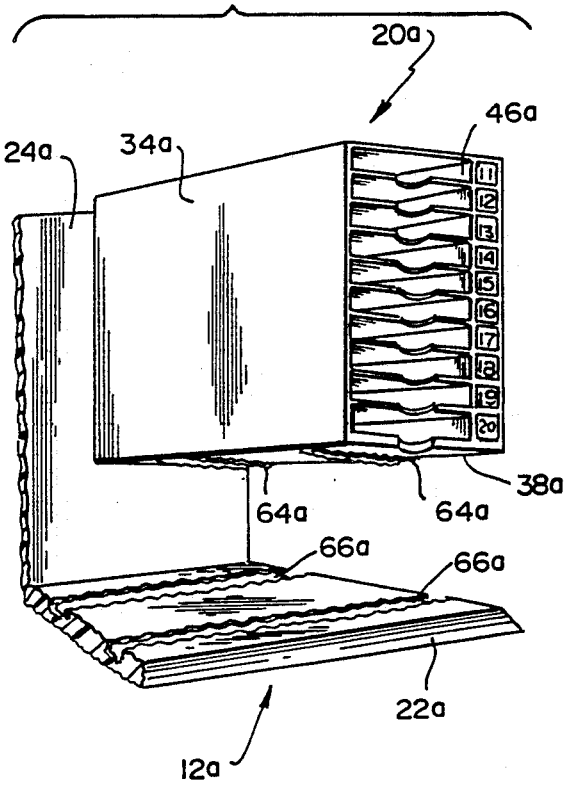
FIG. 9
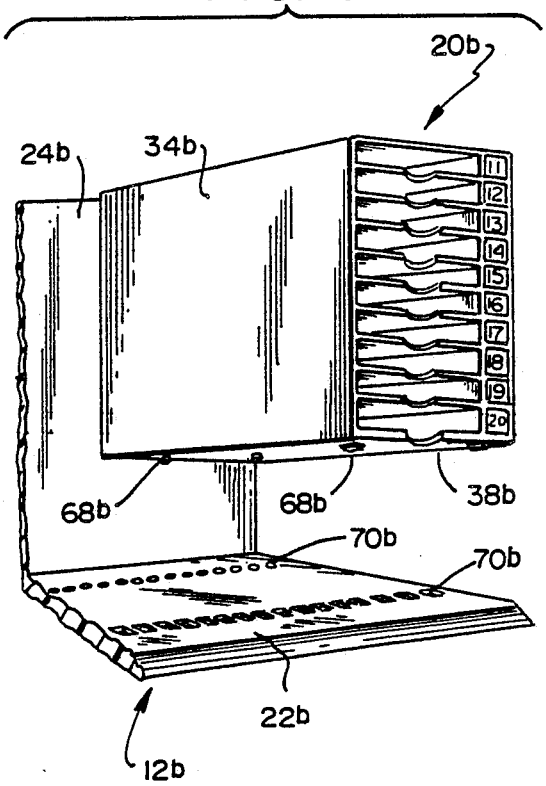

BOOK AND TRANSCRIPTION FILE

BACKGROUND OF THE INVENTION

1. Field of the Invention

The present invention relates generally to books with accompanying text transcriptions on audio tapes and more particularly to a file system for storage and retrieval of books and transcription tapes.

2. Prior History

The practice of providing children's books with accompanying prerecorded audio transcriptions found its origins with the practice of parents reading to their children and was a natural outgrowth of the invention and commercialization of the phonograph. This technique has been employed on a continuing basis with children's books, for both entertainment and pedagogic purposes. It was also employed in conjunction with techniques relating to music instruction and appreciation and was well suited for the teaching of foreign languages and braille.

With the advent of magnetic audio tapes and, more particularly, with the introduction of magnetic tapes carried in standardized, easy-to-use audio cassettes, a resurgence of book and magnetic tape transcription sets has resulted.

The utilization of accompanying transcription cassettes with children's books became popular because it provided a learning experience for young children in terms of familiarizing children with books and assisted in the acquisition of basic reading skills. In addition, since the use of books with transcriptions carried on audio cassettes did not require adult supervision, they were frequently employed by parents who desired activities which did not mandate direct supervision.

The use of books with audio cassette textual transcriptions was subject to some problems, however. While the book and transcription cassette was sold as a single unit and was often carried in packaging adapted to keep the book and cassette together, such as that shown in U.S. Pat. No. 3,641,684, often children would leave the cassette in the cassette player while returning the book to its shelf or, misplaced one or the other after the book was separated from the cassette. Further, children who utilized transcription cassettes with books generally could not read and experienced difficulty in coordinating the book and its accompanying transcription cassette from a plurality of books and transcription cassettes.

SUMMARY OF THE INVENTION

In compendium, the invention comprises a book and cassette filing system for coordinating books and transcription audio cassettes which is particularly adapted for children or adults who have little or no reading skill. The system includes a base and a pair of book end audio cassette storage racks. Matching child cognizable indicia such as numbers, letters, shapes and pictographs are applied to the cassette, the accompanying coordinated book and a compartment assigned to the cassette in a book end rack.

The system includes a base upon which the book end racks are seated. Various mechanisms may be employed to prevent the book end racks from being displaced from the base during book removal and due to forces applied by the books positioned between the racks.

The base includes an integral web which is received in one of a plurality of slots formed between a series of parallel vanes formed in the rear of the book end rack. Registration of the web with a selected slot fixes the position of a book end rack relative to the base to accommodate the number of books carried by the base.

In alternate embodiments, depending projections from the bottom of the book end rack extend into selected receptacles provided in the base to adjustably fix the position of the book end racks relative to the base. Further embodiments include a track or keyway formed in the base and a mating key projecting from the bottom of the rack. Frictional engagement between the key and the keyway prevents undesired lateral movement of book end racks. Optionally, the racks may be spring biased toward one another or a saw tooth arrangement may be employed in the key and keyway to prevent undesired movement of the racks.

From the foregoing summary, it will be appreciated that it is a consideration of the present invention to provide a book and transcription file system of the general character described which overcomes the disadvantages of the prior history aforementioned.

A feature of the present invention is to provide a book and transcription file system of the general character described which is well adapted to be employed by children or adults with poor reading skills.

An aspect of the present invention is to provide a book and transcription file system of the general character described which is low in cost and well suited for economical mass production fabrication.

Another consideration of the present invention is to provide a book and transcription file system of the general character described which reduces the incidence of lost or misplaced transcription tapes and books.

A feature of the present invention is to provide a book and transcription file system of the general character described which can be marketed alone or as a component part of a collection or library of books and tapes.

To provide a book and transcription file system of the general character described which facilitates the selection of the appropriate companion transcription cassette for a selected book by a child or adult who has little or no reading skills is a further consideration of the present invention.

Yet another feature of the present invention is to provide a book and transcription file system of the general character described which promotes increased familiarity of children with books.

Other features, aspects and considerations of the present invention in part will be pointed out hereinafter.

With these ends in view, the invention finds embodiment in certain combinations of elements, arrangements of parts and series of steps by which the said aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which are shown some of the various possible exemplary embodiments of the invention.

FIG. 7 is a sectional view through the base, the same taken substantially along the line 7—7 of FIG. 6 and additionally through a book end audio cassette rack for illustration of the engagement between the rack and the base;

FIG. 8 is a reduced scale fragmentary perspective exploded view of an alternate embodiment of the invention wherein undesired movement of the book end racks is prevented by engagement between sinusoidal strip projections extending from the rack which engage mating tracks in the base;

FIG. 9 is a fragmentary perspective exploded view of a further embodiment of the book and transcription file system and showing engagement between projections extending from the book end rack and receptacles formed in the base;

DESCRIPTION OF THE PREFERRED EMBODIMENTS

Figure 1:
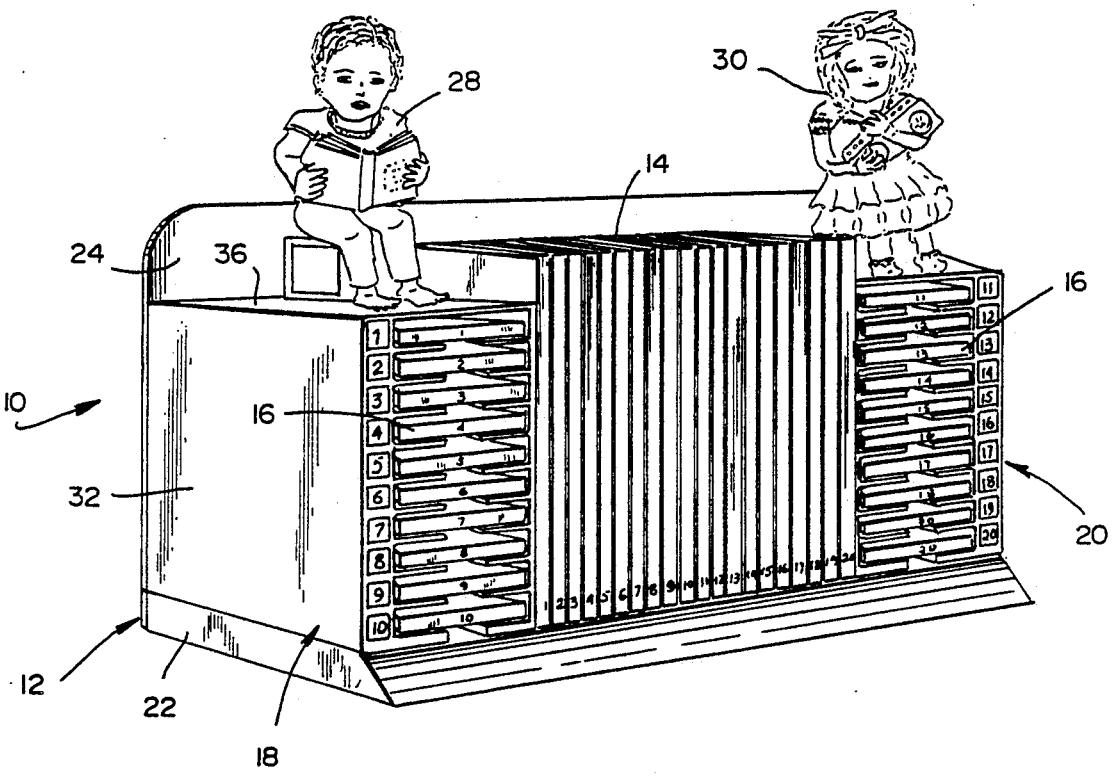
FIG. 1 is a perspective illustration of a book and transcription file system construction in accordance with and embodying the invention and showing a plurality of books carried between a pair of book end audio cassette racks.

Referring now in detail to the drawings, the reference numeral 10 denotes generally a book and transcription file system constructed in accordance with and embodying the invention. The system 10 includes a base 12 which is adapted to store and file a row of children books 14 as well as a like number of coordinated companion audio transcription cassettes 16. The cassettes 16 are stored and filed in a pair of book end cassette racks 18, 20 which are also carried on the base 12.

Figure 6:
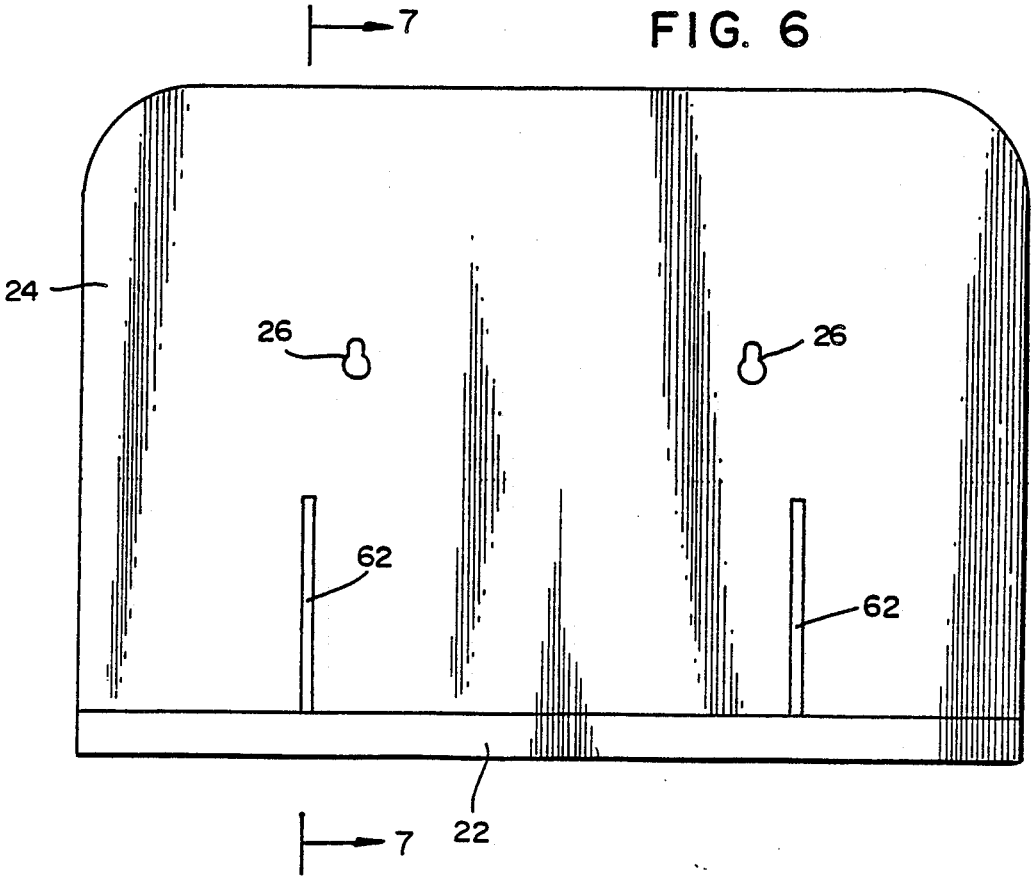
FIG. 6 is a front elevational view of a base of the book and transcription file system, without the book end cassette racks, and showing a pair of webs projecting from the base, each of which may be selectively received in a slot between the vanes.

It should be noted that the base 12 may be comprised of a bottom panel 22 and a rear panel 24 which are oriented perpendicular to one another. The entire book and transcription file system 10 with the books and cassettes filed therein, is readily adapted to be positioned on a shelf of a bookcase or may be mounted to a wall or other vertical support surface through a suitable rear mount arrangement, such as a pair of necked apertures 26 formed through the rear panel 24 and illustrated in FIG. 6. The apertures 26 are engaged by screws, nails or other fasteners which are anchored to the wall.

The cassette racks 18, 20 are structurally mirror images of one another except however, the cassette racks illustrated in FIG. 1 include different ornamental FIGS. 28, 30 suitable for stimulating, amusing or educating children or adults and illustrating the functionality of the invention by depicting one character reading and the other holding a cassette player and listening to a tape. Each book end cassette rack 18, 20 includes a pair of rectangular side walls 32, 34 which are parallel to one another, a rectangular top 36 and a bottom panel 38.

The book end cassette racks 18, 20 also include a plurality of uniformly spaced shelves 40 which extend parallel to the top 36 and the bottom panel 38. The spaces between the shelves 40 form compartments each dimensioned to carry a selected audio cassette 16. A notch 42 is cut away from the front edge of each shelf 40 as well as the bottom panel 38 to facilitate gripping a cassette stored in each compartment for removal.

Registered with each of the cassette compartments on the front face of the racks 18, 20 is a series of indicia panels 44. The panels 44, the cassettes 16 and the spines of the books 14 all include surfaces which carry indicia either directly molded or printed thereon or affixed as decals, pressure sensitive labels, or the like. The indicia panels 44 are framed by the side wall 32 and an interior wall 46 which extends parallel to the side wall 32 and forms a vertical interior wall of each of the compartments.

Figure 2:
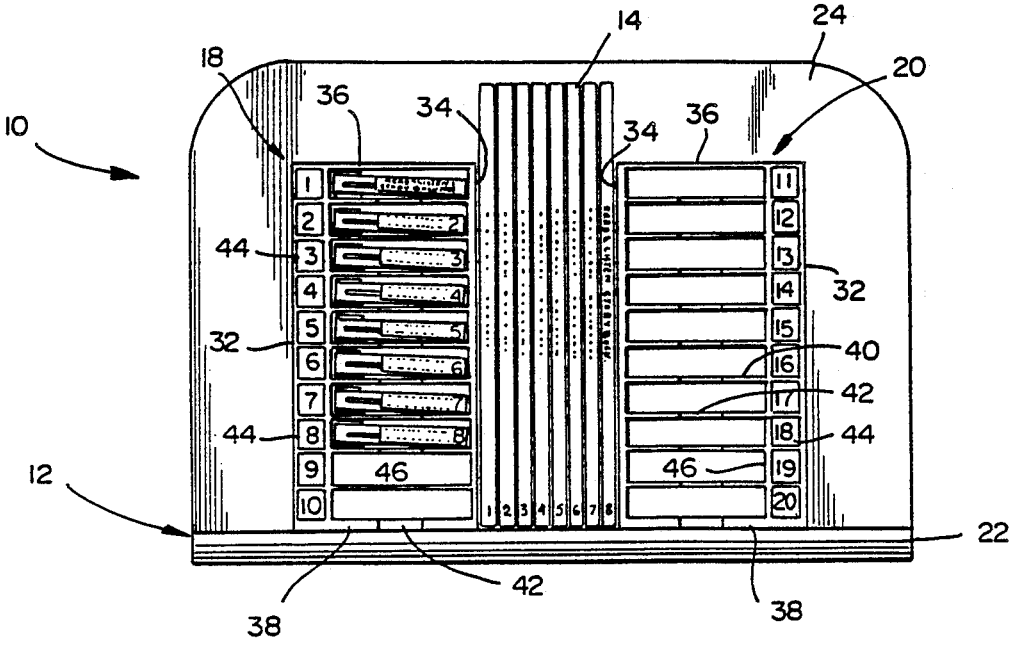
FIG. 2 is an enlarged scale front elevational view of the book and transcription file system carrying less books and companion audio cassettes than in FIG. 1 and showing the book end audio cassette racks without decorative figures.

The indicia panels 44, as illustrated in FIGS. 1 and 2, comprise numeric indicia and corresponding numeric indicia is carried on each of the cassettes to thereby assign a particular compartment to a particular cassette. In order to assist a child in selecting the appropriate transcription cassette which is the companion to a selected book, corresponding numeric indicia is imprinted on the book itself. A child who does not know how to read will be able to coordinate the numeric indicia on the book with the numeric indicia on the panels 44 as well as the numeric indicia appearing on the transcription cassette.

Figure 3:
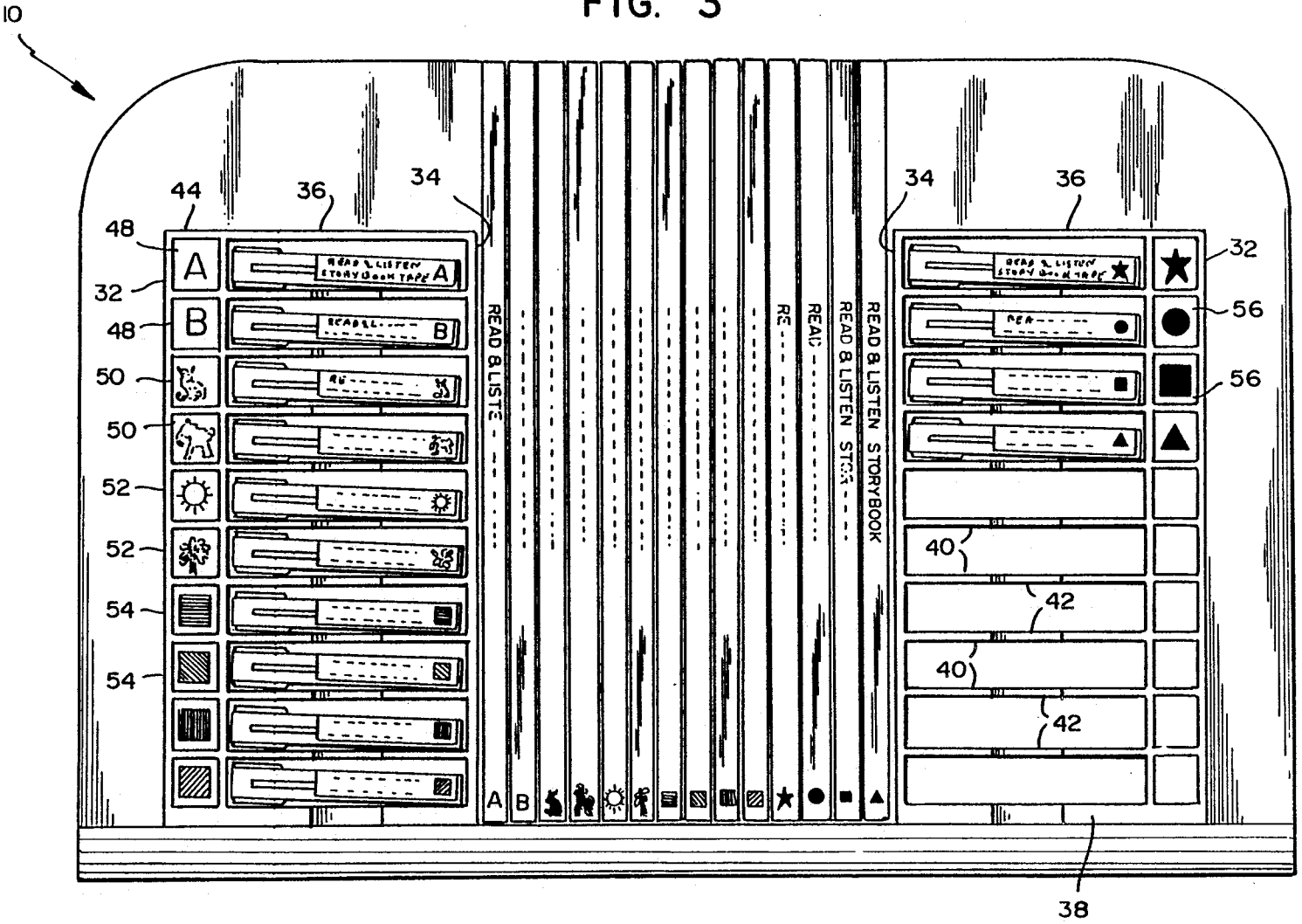
FIG. 3 is an enlarged scale front elevational view of the book and transcription file system and showing various alternate indicia formats for coordination of books with their companion audio cassettes.

If the book and transcription file system 10 is to be used by individuals who are unable to coordinate numeric indicia, or if indicia symbolizing subject matter is desired, alternate indicia such as one or more of those illustrated in FIG. 3 may be employed in the indicia panels 44, on the ends of the cassettes 16 and on the books 14. Shown in FIG. 3 are examples of different indicia types such as letter indicia 48, animal or character indicia 50, pictographic indicia 52, color indicia 54 and geometric symbol indicia 56.

The book and transcription file system 10 may be supplied with preprinted indicia in each of the indicia panels 44. This is particularly desired when the system 10 is offered in conjunction with a subscription to a series comprising a predetermined number of books and companion transcription cassettes. A typical series comprises a given number of books having predetermined thicknesses and a like number of companion transcription cassettes. The dimensions of the books are coordinated with those of the transcription file such that the entire series will completely fill the file system as illustrated, for example, in FIG. 1. In accordance with the invention, the file system can accommodate fewer books and cassettes than a complete subscription series and may be accompanied by a plurality of decal indicia for use in the storage of book and companion transcription cassettes obtained from different sources.

The book and transcription file system 10 is well suited of the permanent storage and filing of less than the maximum number of books and companion cassettes. For example, the number of books and companion cassettes illustrated in FIG. 2 may be a permanent configuration.

The system 10 includes mechanisms to assure that the book and cassette racks 18, 20 are symmetrically positioned relative to the center of the base 12 and, in addition, that an unloaded (light weight) book end cassette rack, such as the rack 20, (FIG. 2) will not move laterally under the force of the books 14 carried in the system or due to forces applied by a child in removing or inserting a selected book.

It should initially be noted that the book and cassette racks 18, 20 are of a depth which is greater than the length of the cassettes 16 and a vertical rear wall 54 is provided as a blind or false back wall of the cassette compartments. The space between the rear wall 54 and the back of the racks may be weighted, that is, carry suitable weights either molded into the racks themselves or secured in a hollow area space between the rear wall 54 and the back end of the racks.

Alternately, one of numerous possible indexing mechanisms may be employed for adjustably fixing the position of the racks 18, 20 and preventing inadvertent movement.

Figure 4:
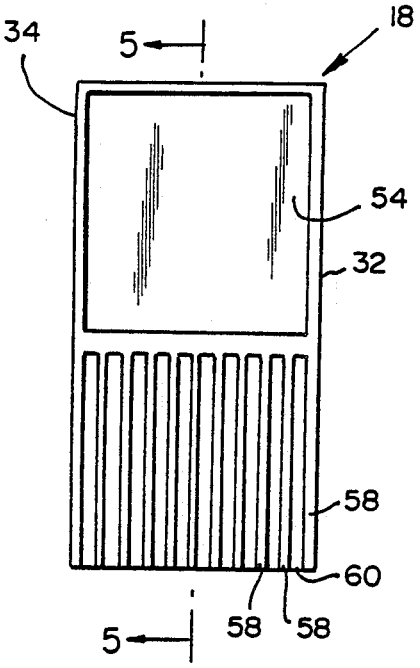
FIG. 4 is a reduced scale rear elevational view of a book end audio cassette rack and showing a plurality of spaced vanes.
Figure 5:
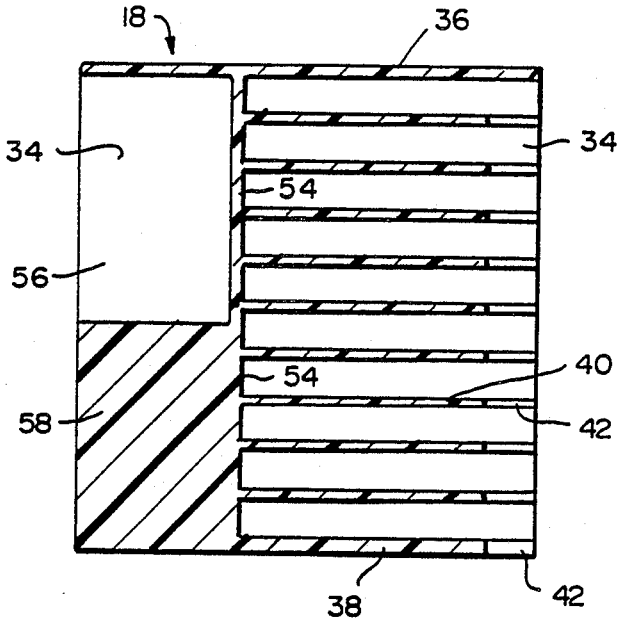
FIG. 5 is a sectional view through a book end audio cassette rack, the same being taken substantially along the line 5—5 of FIG. 4 and through one of the vanes.

Referring now to FIG. 4, which comprises a rear elevational view of the cassette rack 18 and FIG. 5 which comprises a sectional view through the rack taken along the line 5—5 of FIG. 4, it will be seen that between the rear wall 54 of the compartments and the rear end of the rack, a hollow area 56 is provided in the upper half of each rack. Beneath the hollow area 56, the rack includes a comb structure comprising a plurality of spaced planar vertical vanes 58. Between each of the vanes 58, a slot 60 which is open at both the bottom and rear faces of the rack is provided. A selected space 60 of each of the racks receives one of a pair of planar webs 62 which project from the bottom panel 22 and rear panel 24 of the base 12 as illustrated in FIG. 7.

The vanes 58 and slots 60 are so dimensioned and proportioned that with the system 10 carrying two books and cassettes, each of the racks 18, 20 are symmetrically positioned with the web 62 being accommodated in the slot 60 closest to the side wall 32 and with the system 10 carrying the maximum number of books and cassettes, as illustrated in FIG. 1, the webs 62 will be received in the slots 60 closest to the side walls 34. Intermediate positions are appropriately indexed to coordinate with the number of books being carried by the system 10, e.g. incremented one slot for each additional book.

Referring now to FIG. 8 wherein an alternate embodiment of the invention is illustrated in fragmentary perspective exploded view, it should initially be noted that like numerals are employed to denote components corresponding to those of the prior embodiment, however, bearing the suffix "a". In the embodiment of FIG. 8, an alternate arrangement is provided for preventing a pair of book end racks from moving inadvertently relative to a base **12*a*. Depicted is a book end cassette rack 20*a* which is substantially identical to the book end cassette rack 20 previously described, however, in lieu of providing vanes and slots for engagement with a web, a bottom panel 38*a* of the rack 20*a* includes a pair of depending sinusoidal strips 64*a*, each of which extends along a longitudinal axis parallel to one another and parallel to the longitudinal axis of a bottom panel 22*a* of the base 12*a*. A pair of mating sinusoidal tracks 66*a* are formed in the surface of the bottom panel 22*a* and the strips 64*a* will seat into the tracks 66*a* at selected intervals along the length of the bottom panel 22*a*, such intervals being indexed along the length of the bottom panel 22** for varying and fixing the position of the racks to accommodate a different number of books.

In order to move a book end racks to a different position to accommodate more or less books then previously carried, the book end rack is lifted vertically, to the position shown in FIG. 8, for example, thereby disengaging the sinusoidal strips **64*a* from the tracks 66*a*. The rack is then moved along the length of the base to a new position and the strips 64*a* are reengaged in the tracks 66*a*** at the new position.

In FIG. 9, a further embodiment of the book and transcription file system is depicted. In this embodiment, like numerals are employed to denote components similar to those described previously, however, bearing the suffix "b". In this alternate embodiment, a plurality of projections **68*b* extend downwardly from a bottom panel 38*b* of each cassette rack. The projections 68*b* may be cylindrical, rectangular, or of any regular or irregular geometric shape and a plurality of uniformly spaced mating receptacles 70*b* are provided in the bottom panel 22*b* of a base 12*b***.

If differently shaped projections extend from the same rack, all projections along a longitudinal axis parallel to the longitudinal axis of the bottom panel **22*b* must be of the same shape and the spacing must coincide so that all projections 68*b* will simultaneously be seated in mating receptacles 70*b*. As with the prior embodiment of FIG. 8**, to laterally move the rack, the rack is lifted to disengage the projections from the receptacles, then moved, and then lowered to reengage the projections in the receptacles at the next selected location.

Figure 10:
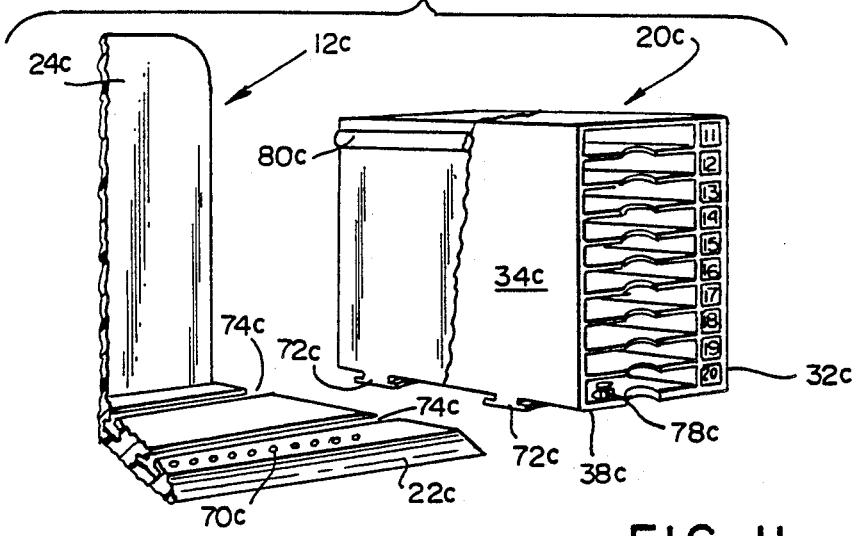
FIG. 10 is a fragmentary perspective exploded view of further embodiments of the book and transcription file system and showing two different stop arrangements for engagement between the book end racks and the base.

Turning next to the embodiments of FIG. 10, it should be noted that a typical book end cassette rack **20*c* is therein depicted in two different configurations. A key or rail 72*c* projects downwardly from a bottom panel 38*c* of the rack 20*c*. The key 72*c* extends along a longitudinal axis which is parallel to the longitudinal axis of a base bottom panel 22*c* and is registered with a mating keyway or track 74*c* formed in the bottom panel 22*c*. The key 72*c* includes a reduced thickness depending neck and an enlarged generally planar foot. The rack 20 is mounted to the base 22*c* by engaging the key 72*c* in the keyway 74*c* with the end of the base abutting a side wall 34*c* of the rack. Thereafter, the rack 20*c* is slid toward the center of the bottom panel 22*c* until a desired position is reached. Once the desired position is reached, a moveable pin 78*c* is depressed to lock the rack in position. The pin 78*c* engages one of a plurality of longitudinally spaced apertures 70*c* formed in the base. To move the rack 20*c* to a different position, the pin 78*c* is lifted, the rack is slid to the new position, and the pin 78*c* is thereafter depressed for insertion into a different receptacle 70*c***.

A further embodiment of the invention is also illustrated in FIG. 10. In this embodiment, the engagement between the key **72*c* and the keyway 74*c* is identical, however, the pin 78*c* is not utilized and receptacles 70*c* are not provided. In order to prevent sliding movement of the racks due to engagement with books, the racks are tipped or pivoted about an axis formed by the key 72c at the side wall 32c. A bumper strip 80c which projects outwardly from the face of the side wall 34c is engaged by a book and the lateral force effects tipping. In such position, the upper surface of the shoe of the key at the side wall 34c frictionally engages the underside of a top lip of the keyway 74c** to prevent lateral movement of the rack.

Figure 11:
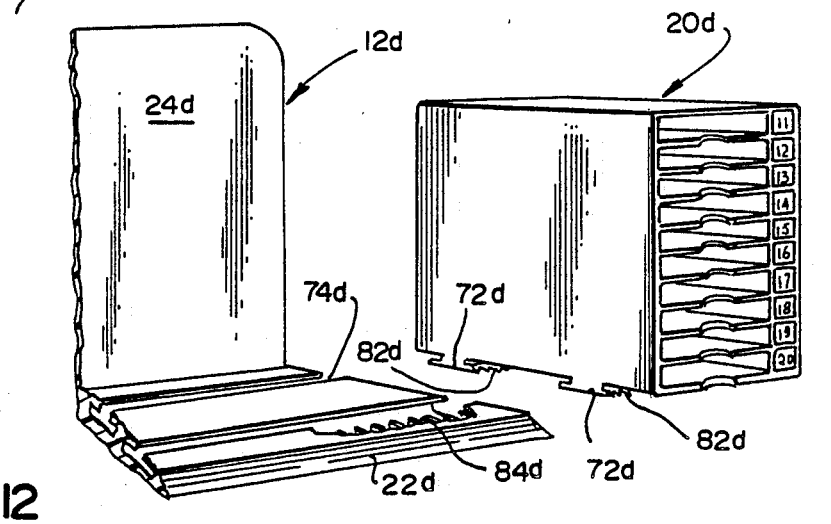
FIG. 11 is a fragmentary perspective exploded view of another embodiment of the book and transcription file system showing a further arrangement for engagement between the book end racks and the base.

In FIG. 11, a still further embodiment of the invention is shown. This embodiment is similar to the embodiments of FIG. 10 and includes a pair of keys 72d which are engaged in keyways 74d of a bottom panel 22d. Undesired lateral movement of book end cassette racks is prevented by a plurality of sloped saw teeth 82d formed on the underside of the key and which mate with a plurality of sloped saw teeth formed on the bottom of the keyway 84d. The saw tooth engagement permits lateral movement of the racks toward the center of the bottom panel 22d. In the presence of lateral forces urging the racks away from the center of the bottom panel 22d, the saw teeth lock to prevent movement. To permit movement in such direction, the racks are lifted and moved slightly laterally, thereby disengaging the mating saw teeth, and then moved to the desired location, and lowered to reengage.

Figure 12:
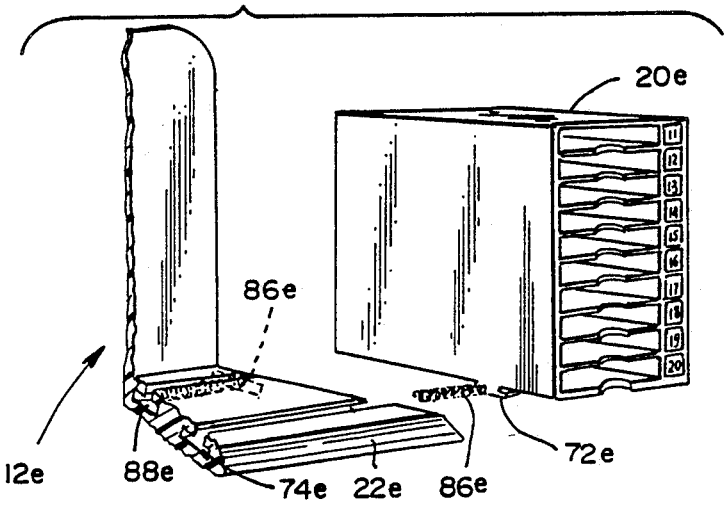
FIG. 12 is a fragmentary perspective exploded view of a further embodiment wherein springs urge the book end racks against the books.

In another embodiment, illustrated in FIG. 12, a single key 72e of a right side book end rack 20e is engaged in a keyway 74e of a bottom panel 22e. The book end rack 20e is urged against the last book in a row of books carried on a base 12e by a helical coil spring 86e, attached, at one of its ends, to the key 72e and, at of the panel 22e. Shown in FIG. 12, in dashed lines, is the blind end of a keyway 88e within which a key of a left side book end rack is engaged.

It should be appreciated that the book and transcription file system may be fabricated of any suitable components, for example, the entire system may be molded of a suitable thermoplastic such as rigid polyvinylchloride, styrene, ABS or like material.

The term "transcription" as employed herein should be understood to include informational material in any medium and not necessarily a verbation transcription of the text in a book medium. By way of example, a "transcription" may comprise narration, musical accompanyment, synopsis, review, instruction, commentary or otherwise related information and/or data.

In addition, it should be understood that the present invention will find application in many different environments and its utility is not limited to children's books and transcriptions or transcriptions on audio cassettes. The system 10 may be employed for filing of sheet music and companion audio transcriptions, foreign language books and transcriptions and software instruction books with companion software on tape, disc or other medium.

In lieu of audio cassettes, transcriptions carried on compact discs, digital magnetic tape or other medium may be filed in the book end racks. It is also possible to utilize the system for storage of video cassettes in the base and companion audio cassettes in the "book end" racks which maintain the video cassettes in a compact row.

Thus it will be seen that there is provided a book and transcription file system which achieves the various aspects, considerations, and features of the present invention and which is well suited to meet the conditions of practical usage.

As various possible embodiments might be made of the present invention and as various changes might be made in the embodiments disclosed without departing from the spirit of the invention, it is to be understood that all matter herein described or shown is to be interpreted as illustrative and not in a limiting sense.

What is claimed is:

1. A book and companion audio transcription file system, the system comprising a plurality of books and a like plurality of audio transcriptions, means for supporting the plurality of books in a row and book end means for abutting a book at one end of the row, the book end means including rack means for storing the plurality of audio transcriptions, the audio transcriptions being coordinated with the books, the rack means including means forming a plurality of compartments, each compartment being dimensioned to receive an audio transcription.

2. A book and companion audio transcription file system constructed in accordance with claim 1 further including additional book end means for abutting a book at the other end of the row, each book end means including rack means for storing a plurality of audio transcriptions.

3. A book and companion audio transcription file system, the system comprising means for supporting a plurality of books in a row and book end means for abutting a book at one end of the row, the book end means including rack means for storing a plurality of audio transcriptions, the audio transcriptions being coordinated with the books, further including a plurality of books having textual material imprinted thereon, different visual indicia means carried on each of the books, a plurality of audio transcriptions, visual indicia means associated with each of the audio transcriptions each audio transcription comprising the prerecorded textual material printed on a book having indicia means corresponding to the indicia means associated with the transcription, the indicia means comprising readily recognizable indicia.

4. A book and companion audio transcription file system as constructed in accordance with claim 1 further including visual indicia means associated with each compartment, the visual indicia means comprising indicia cognizable by children, the system further including corresponding indicia means for affixation to books and audio transcriptions.

5. A book and companion audio transcription file system the system comprising means for supporting a plurality of books in a row and book end means for abutting a book at one end of the row, the book end means including rack means for storing a plurality of audio transcriptions, the audio transcriptions being coordinated with the books, wherein the transcriptions are recorded on magnetic tape carried in cassettes, the system further including a plurality of books having textual material imprinted thereon, a plurality of audio cassettes, the cassettes including transcriptions of the textual material imprinted in the books, the books being positioned in a row on the supporting means, the book end means engaging a book at one end of the row, the plurality of audio cassettes being stored in the rack means.

6. A file system for storage and access of information recorded in two different formats, the file system including a plurality of first components and a plurality of second components, means for supporting the plurality of first components in side by side position in a row, each first component carrying information transcribed in one format and means for abutting a first component at one end of the row, the abutting means including rack means for storing the plurality of second components, the second components carrying transcriptions in another format, the second component transcriptions being related to the information transcribed in the one format.

7. A file system constructed in accordance with claim 6 further including additional means for abutting a first component at the other end of the row, each abutting means including rack means for storing a plurality of second components.

8. A book and companion audio transcription file system, the system comprising a base member for supporting a plurality of books in a row and a book end member for abutting a book at one end of the row, the book end member including rack means for storing a plurality of audio transcriptions, the audio transcriptions being coordinated with the books, and means for precluding undesired movement of the book end member, the means for precluding including means projecting from one of the members into one of a plurality of spaced receptacles formed in the other member, whereby the position of the book end member relative to the base member may be adjustably fixed.

9. A book and companion audio transcription file system as constructed in accordance with claim 8 wherein the one member is the base member.

10. A book and companion audio transcription file system is constructed in accordance with claim 8 wherein the one member is the book end member.

* * * * *